US005711827A

United States Patent [19]

Sawada et al.

[11] Patent Number: 5,711,827

[45] Date of Patent: Jan. 27, 1998

[54] SUPPORT FOR PLANOGRAPHIC PRINTING PLATE AND METHOD FOR PRODUCING THE SAME

[75] Inventors: Hirokazu Sawada; Akio Uesugi; Tsutomu Kakei, all of Shizuoka, Japan

[73] Assignee: Fuji Photo Film Co., Ltd., Kanagawa, Japan

[21] Appl. No.: 399,039

[22] Filed: Mar. 6, 1995

[30] Foreign Application Priority Data

Mar. 17, 1994 [JP] Japan ..... 6-071264
Jun. 8, 1994 [JP] Japan ..... 6-148785

[51] Int. Cl.[6] ..... C22F 1/04

[52] U.S. Cl. ..... 148/552; 148/695; 148/696; 205/661

[58] Field of Search ..... 148/552, 688, 148/691, 695, 696, 437; 420/528, 548, 550; 164/476, 477; 205/661

[56] References Cited

U.S. PATENT DOCUMENTS 5,078,805 1/1992 Uesugi et al. ..... 148/551
5,350,010 9/1994 Sawada et al. ..... 164/476

FOREIGN PATENT DOCUMENTS 0415238 3/1991 European Pat. Off. .
0581321 2/1994 European Pat. Off. .
0643149 3/1995 European Pat. Off. .
0652298 5/1995 European Pat. Off. .

OTHER PUBLICATIONS

Patent Abstracts of Japan, vol. 011, No. 136 (C–419) 30 Apr. 1987.
Patent Abstracts of Japan, vol. 018, No. 098 (M–1562) 17 Feb. 1994.
Patent Abstracts of Japan, vol. 017, No. 639 (M–1515) 26 Nov. 1993.
Patent Abstracts of Japan, vol. 015, No. 425 (C–0879) 29 Oct. 1991.

*Primary Examiner*—George Wyszomierski
*Attorney, Agent, or Firm*—Sughrue, Mion, Zinn, Macpeak & Seas, PLLC

[57] ABSTRACT

There are disclosed a support for a planographic printing plate, which decreases dispersion in a material quality of an aluminum alloy support and improves a yield of an electrolytic graining treatment and which can produce the planographic printing plate having a small heat softening property after a burning treatment and providing a low cost, and a method for producing the same. The support for the planographic printing plate is an aluminum alloy plate comprising $0<Fe\leqq0.20$ weight %, $0\leqq Si\leqq0.13$ weight %, 99.7 weight $\%\leqq Al$ and the balance of inevitable impurity elements, wherein a solid solution amount of Fe is 10 ppm to 800 ppm, and the support has a tensile strength of 14 kg/mm$^2$ or more and an offset stress of 10 kg/mm$^2$ or more when it is subjected to a heat treatment by holding at 300° C. for 7 minutes.

2 Claims, 1 Drawing Sheet

SUPPORT FOR PLANOGRAPHIC PRINTING PLATE AND METHOD FOR PRODUCING THE SAME

FIELD OF THE INVENTION

The present invention relates to a support used for a planographic printing plate and a method for producing the same, particularly to a support for a planographic printing plate, which is suited to an electrochemical graining treatment and which does not soften easily even when it is subjected to a burning treatment after coating a photosensitive layer followed by carrying out a development after exposure, and a method for producing the same.

BACKGROUND OF THE INVENTION

As an aluminum support for printing plate, particularly for offset printing plate there is used an aluminum plate (including aluminum alloy plate).

In general, an aluminum plate to be used as a support for offset printing plate needs to have a proper adhesion to a photosensitive material and a proper water retention.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example, a normal alternating waveform such as a sinewaveform, a special alternating waveform such as a squarewaveform, and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic power source (JP-A-53-67507). (The term "JP-A" as used herein means an "unexamined published Japanese patent application".) Another method is to control a ratio between an electricity quantity of a positive period and that of a negative period at the time of alternating electrolytic graining (JP-A-54-65607). Still another method is to control the waveform supplied from an electrolytic power source (JP-A-55-25381). Finally, another method is directed to a combination of current density (JP-A-56-29699).

Further, known is a graining method using a combination of an AC electrolytic etching method with a mechanical graining method (JP-A-55-142695).

A grained alloy support is subjected to an anodic oxidation treatment and further subjected to a hydrophilicity treatment in some cases, followed by coating a photosensitive substance thereon and drying to prepare a so-called presensitized (PS) plate. There are used those prepared by subjecting the PS plate to a plate-making treatment such as image exposure, development and gumming, wherein in order to improve a durability of a printing plate, it is sometimes subjected to a burning treatment in which soaking is provided at 200° to 300° C. for about 3 to 10 minutes, after development.

The burning treatment has an effect for thermosetting a photosensitive layer resin remained on an aluminum plate but it in turn is liable to cause heat-softening by heating.

As the method of producing an aluminum support, on the other hand, known is a method in which an aluminum ingot is melted and held, and then cast into a slab (having a thickness in a range from 400 to 600 mm, a width in a range from 1,000 to 2,000 mm, and a length in a range from 2,000 to 6,000 mm). Then, the cast slab thus obtained is subjected to a scalping step in which the slab surface is scalped by 3 to 10 mm with a scalping machine so as to remove an impurity structure portion on the surface. Next, the slab is subjected to a soaking treatment step in which the slab is kept in a soaking furnace at a temperature in a range from 480° to 540° C. for a time in a range from 6 to 12 hours, thereby to remove any stress inside the slab and make the structure of the slab uniform. Then, the thus treated slab is hot rolled at a temperature in a range from 480° to 540° C. to a thickness in a range from 5 to 40 mm. Thereafter, the hot rolled slab is cold rolled at room temperature into a plate of a predetermined thickness. Then, in order to make the structure uniform and improve the flatness of the plate, the thus cold rolled plate is annealed thereby to make the rolled structure, etc. uniform, and the plate is then subjected to correction by cold rolling to a predetermined thickness. Such an aluminum plate obtained in the manner described above has been used as a support for a planographic printing plate.

However, electrolytic graining is apt to be influenced by an aluminum support to be treated. If an aluminum support is prepared through melting and holding, casting, scalping and soaking, even though passing through repetition of heating and cooling followed by scalping of a surface layer, scattering of the metal alloy components is generated in the surface layer, causing a drop in the yield of a planographic printing plate.

In case of producing an aluminum plate via the processes of melting and holding—casting—scalping— soaking, a thermosoftening property was large particularly in an alloy component closer to pure Al such as an AA1050 material, and it could not stand the burning treatment at a high temperature.

A method for producing a support for a planographic printing plate described in U.S. Pat. No. 5,078,805 (corresponding to JP-A-3-79798) characterized by that casting and hot rolling are continuously carried out from molten aluminum to form a hot rolled coil of thin plate and then, an aluminum support subjected to cold rolling, heat-treatment and correction is subjected to a graining treatment was previously proposed by the present applicant as a method in which a planographic printing plate having an excellent quality and a good yield can be produced by decreasing dispersion in a material quality of the aluminum support to improve a yield of an electrolytic graining treatment.

In addition thereto, it is proposed in U.S. Pat. No. 5,350,010 (corresponding to JP-A-6-48058) that in order to obtain a good electrolytic graining property, a continuous casting is carried out with a mixing ratio comprising Fe: 0.4 to 0.2%, Si: 0.2 to 0.05%, Cu: 0.02% or less and Al: 99.5% or more, wherein of a content of Fe, 20 to 90% exists in a grain boundary.

Further, JP-A-62-146694, JP-A-60-230951, JP-A-60-215725, JP-A-61-26746, and JP-B-58-6635 (the term "JP-B" as used herein means an "examined Japanese patent publication, and the term "JP-A" as used herein means an unexamined published Japanese patent application.) are disclosed as the inventions in which the alloy components of the supports are prescribed.

For a problem that an alloy component closer to pure Al such as AA1050 provides a large heat softening property and can not stand a burning treatment at a high temperature, a method of including zirconium of 0.02 to 0.20% is disclosed in JP-A-61-51395, a method of regulating an intermediate annealing temperature is disclosed in JP-A-61-272357 and JP-A-60-5861, and a method of regulating conductivity is disclosed in JP-A-59-67349.

However, the production method proposed previously by the present applicant also involved dispersion in the yield of the electrolytic graining treatment and a graining suitability according to the components of an aluminum support.

SUMMARY OF THE INVENTION

An object of the present invention is to provide a support for a planographic printing plate, which decreases dispersion in a material quality of an aluminum alloy support and improves a yield of an electrolytic graining treatment and which can produce the planographic printing plate having a small heat softening property after a burning treatment and providing a low cost, and a method for producing the same.

As the result of various investigations on relationship of the aluminum support with the electrolytic graining treatment and a mechanical strength, it has been found out by the present inventors that a cause of dispersion in graining is due to dispersion in a distribution of a trace alloy component such as Fe and Si, and in particular, it is due to unevenness of the graining at a portion where a deposition amount of Fe is too much and a portion where a solid solution amount of Fe is too small and further that either or both of a manner for carrying out a heat treatment and a cooling speed in casting can be optimized in a production process to decrease the heat softening property after the burning treatment. As a result, the present invention has been found out.

That is, the above object of the present invention is achieved by:

(1) a support for a planographic printing plate, which is an aluminum alloy plate comprising $0<Fe\leqq0.20$ weight %, $0\leqq Si\leqq0.13$ weight %, 99.7 weight $\%\leqq Al$, and the balance of inevitable impurity elements, wherein a solid solution amount of Fe is 10 ppm to 800 ppm.

(2) a support for a planographic printing plate, which is an aluminum alloy plate comprising $0<Fe\leqq0.20$ weight %, $0\leqq Si\leqq0.13$ weight %, 99.7 weight $\%\leqq Al$, and the balance of inevitable impurity elements, wherein the support has a tensile strength of 14 $kg/mm^2$ or more and an offset stress of 10 $kg/mm^2$ or more when it is subjected to a heat treatment by holding at 300° C. for 7 minutes, (3) a method for producing a support for a planographic printing plate, comprising:

preparing an aluminum cast ingot via a fixed water-cooling mold after melting and mixing aluminum to comprise $0<Fe\leqq0.20$ weight %, $0\leqq Si\leqq0.13$ weight %, 99.7 weight $\%\leqq Al$ and the balance of inevitable impurity elements, subjecting the cast ingot to scalping and to a soaking treatment at a temperature of 280° C. to 650° C. for 2 hours to 15 hours, then rolling it to a thickness of 0.5 to 0.1 mm and further carrying out correction to prepare the support, and subjecting the support to graining, (4) a method for producing a support for a planographic printing plate, comprising:

casting an aluminum thin plate with a driven water-cooling casting mold after melting and mixing aluminum to comprise $0<Fe\leqq0.20$ weight %, $0\leqq Si\leqq0.13$ weight %, 99.7 weight $\%\leqq Al$ and the balance of inevitable impurity elements, then rolling it to a thickness of 0.5 to 0.1 mm and further carrying out correction by cold rolling to prepare the support, and subjecting the support to graining, (5) a method for producing a support for a planographic printing plate, comprising casting aluminum, carrying out once or more times either or both of rolling and heat treatment to prepare a plate having a thickness of 0.5 to 0.1 mm, and subjecting an aluminum alloy support corrected to graining, wherein aluminum alloy comprising $0<Fe\leqq0.20$ weight %, $0\leqq Si\leqq0.13$ weight %, 99.7 weight $\%\leqq Al$ and the balance of inevitable impurity elements is melted and casted, and a heat treatment is carried out in the middle or end of cold rolling to finish to a thickness of 0.5 to 0.1 mm, and (6) a method for producing a support for a planographic printing plate, comprising casting aluminum, carrying out once or more times either or both of rolling and heat treatment to prepare a plate having a thickness of 0.5 to 0.1 mm, and subjecting an aluminum alloy support corrected to graining, wherein aluminum alloy comprising $0<Fe\leqq0.20$ weight %, $0\leqq Si\leqq0.13$ weight %, 99.7 weight $\%\leqq Al$ and the balance of inevitable impurity elements is melted and casted at a cooling speed of 10° C./sec or more.

BRIEF DESCRIPTION OF THE DRAWINGS

FIG. 1 is a schematic view showing one example of a casting process in the production method of the support for the planographic printing plate of the present invention.

FIG. 2 is a schematic view showing another example of the casting process in the production method of the support for the planographic printing plate of the present invention.

FIG. 3 is a schematic view showing one example of a cold rolling process in the production method of the support for the planographic printing plate of the present invention.

FIG. 4 is a schematic view showing one example of a correction process in the production method of the support for the planographic printing plate of the present invention.

FIG. 5 is a schematic view showing one example of a heat treatment process of a continuous annealing (CAL) system.

FIG. 6 is a schematic view showing one example of a heat treatment process in a batch system.

Figure 1:
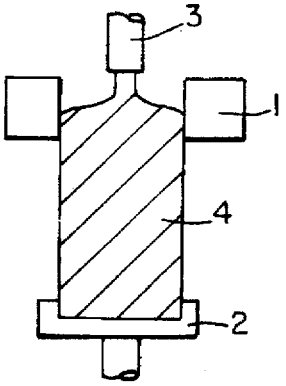
FIG. 1.

Explanation of symbols:

1. Water-cooling casting mold.
2. Ingot-receiving tray.
3. Molten aluminum-supplying nozzle.
4. Ingot.
5. Melt holding furnace.
6. Twin roller continuous casting machine.
7. Coiler.
8. Cold rolling machine.

9. Correction apparatus.
10. Continuous annealing (CAL) system apparatus.
11. Batch system heat treatment apparatus.

DETAILED DESCRIPTION OF THE INVENTION

In the present invention, a casting technique such as a DC method is put to practical use for a method to produce an aluminum cast ingot from molten aluminum with, for example, use of a fixed cast mold.

A method using a cooling belt, such as a Hazelett method and a method using a cooling roller, such as a Hunter method and a 3C method can be used as a continuous casting method using a driven cast mold. Further, a method for producing a coil of a thin plate is disclosed in JP-A-60-238001 and JP-A-60-240360.

In the present invention, a constitutional range of an alloy component and a solid solution amount range for Fe as described above are selected., and simplification of the raw materials and a mechanical strength are put in the prescribed ranges. Relationship of the Fe solid solution amount in an alloy component composition is as follows.

In the present invention, in order to obtain an excellent property for a support for a planographic printing plate, the Fe component is $0<Fe\leqq0.20$ weight %, preferably $0.05\leqq Fe\leqq0.19$ weight % and particularly preferably $0.08\leqq Fe\leqq0.18$ weight %. The Fe solid solution amount is 10 ppm to 800 ppm, preferably 20 ppm to 700 ppm, particularly preferably 30 ppm to 600 ppm. It has so far been said that Fe is necessary to improve a mechanical strength and the content thereof less than the lower limit provides the insufficient effect thereof. However, it has been found by the present inventors that the selection of a condition in a production process of an aluminum alloy plate does not damage the mechanical strength even with $0<Fe\leqq0.20$ weight %. That is, for the condition in the production process, which will be described in detail later, there may be selected either or both of a method in which a manner carrying out a heat treatment in the middle or end of cold rolling is specified and a method in which a cooling speed in casting is set to 10° C./sec or more.

Further, it was found out by the present inventors that streaked unevenness caused in electrochemical graining was due to a difference of a concentration distribution of Fe. Fe falling within the range of $0<Fe\leqq0.20$ weight % can make it difficult to generate the difference of the concentration distribution of Fe, which is liable to cause the streaked unevenness.

With respect to the solid solution amount of Fe, it was found that a pit size in the electrochemical graining became uneven particularly around a portion where the Fe solid solution amount was low, and the Fe solid solution amount was therefore set to 10 ppm or more. An upper limit of the solid solution amount was set at 800 ppm considering oversaturation caused in casting.

In the present invention, a Si component falls within a range of $0\leqq Si\leqq0.13$ weight %, preferably $0.02\leqq Si\leqq0.12$ weight %, and particularly preferably $0.25\leqq Si\leqq0.10$ weight %.

Since Si sometimes forms an intermetallic compound with Fe, particularly in the case where Si is much or Fe is little, a large part of the whole amount of Fe is turned to the intermetallic compound, which results in allowing the solid solution amount of Fe dissolved in an aluminum matrix to decrease and leading to the unevenness of the pit size as described above. Accordingly, Si was set to $0\leqq Si\leqq0.13$ weight %.

With respect to 99.7 weight %≦Al, setting to 99.7 weight %≦Al enables to use a 99.7 weight %≦Al of ingot material which is commercially available in the market at an inexpensive price, and it has an effect on cost reduction of a material.

In order to prevent deterioration of a graining form, the upper limit thereof is preferably 99.9%.

In addition, since the content of the inevitable impurities is limited, surface treatment property, staining property and burning property are not particularly badly affected.

Next, as follows is a production method for providing the support for the planographic printing plate of the present invention as described above with a tensile strength of 14 kg/mm$^2$ or more and an offset stress of 10 kg/mm$^2$ or more when a heat treatment is carried out by holding at a heating temperature of 300° C. for 7 minutes without damaging a mechanical strength and for producing it under control of the solid solution amount of Fe.

Figure 3:
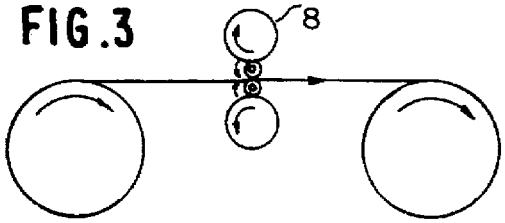
FIG. 3.
Figure 4:
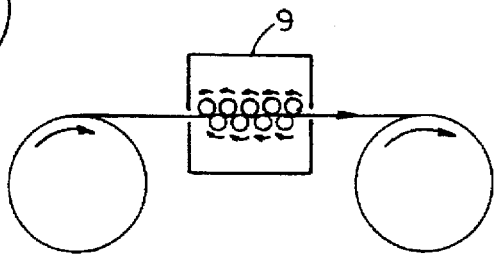
FIG. 4.
Figure 5:
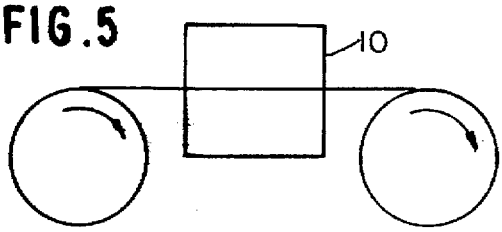
FIG. 5.
Figure 6:
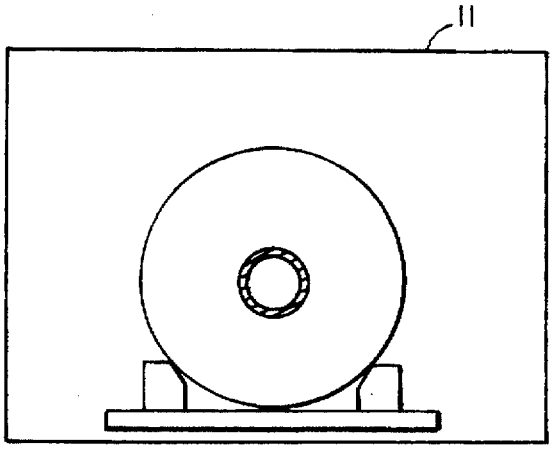
FIG. 6.

By the schematic views of FIG. 1 to FIG. 6 one of the embodiments of the production method for the aluminum alloy support used in the present invention is concretely explained below. An Al material is melted and adjusted to $0<Fe\leqq0.20$ weight % and $0\leqq Si\leqq0.13$ weight % in a melt holding furnace (which is not illustrated), and the (molten aluminum) melt is subjected to a degassing treatment and a removing treatment of inclusions (not illustrated) according to necessity. Then, the (molten aluminum) melt is supplied from the molten aluminum-supplying nozzle 3 to the ingot-receiving tray 2 through the water-cooling fixed casting mold to form the ingot 4, wherein the ingot is subjected to scalping and to a heat treatment at a temperature of 280° C. to 650° C., preferably 400° C. to 630° C. and particularly preferably 500° C. to 600° C. for time of 2 hours to 15 hours, preferably 4 hours to 12 hours and particularly preferably 6 hours to 11 hours; then, it is subjected to cold rolling with the cold rolling machine 8 as shown in FIG. 3; it is subjected to a heat treatment with the heat treatment apparatus shown in FIG. 5 or FIG. 6 according to necessity; finally, it is rolled to a thickness of 0.5 mm to 0.1 mm; and further, it is subjected to correction with the correcting apparatus 9 as shown in FIG. 4, whereby the aluminum support is produced. In this case, carrying out the heat treatment in the middle or at the end of the cold rolling to set the final thickness to 0.5 to 0.1 mm means either carrying out the heat treatment in the middle of the cold rolling when a plate thickness is 3 to 5 times the final plate thickness and further carrying out the cold rolling to set the final thickness to 0.5 to 0.1 mm or carrying out the heat treatment by the continuous annealing (CAL) system in the middle or end of the cold rolling. Or, finishing to the thickness of 0.5 to 0.1 mm can be carried out in the middle of the cold rolling with either of the methods in which a batch system heat treatment of 400° C. or higher is carried out to materialize the tensile strength of 14 kg/mm$^2$ or more and the offset stress of 10 kg/mm$^2$ or more when the heat treatment is carried out by holding at the heating temperature of 300° C. for 7 minutes. There was shown herein an example in which the thickness was reduced by carrying out the cold rolling after casting, scalping and the heat treatment but the present invention is not limited thereto, and after first setting the thickness to some level with a hot rolling machine (which is not illustrated), it may be finished to the thickness of 0.5 to 0.1 mm with the cold rolling machine as shown in FIG. 3.

The aluminum support thus-obtained can be subjected to graining to prepare the support for the planographic printing plate.

Next, another embodiment of the present invention is concretely explained.

Figure 2:
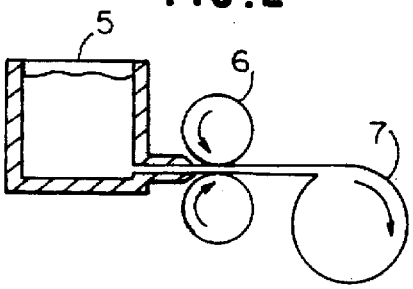
FIG. 2.

An Al material is melted and adjusted to $0<Fe\leqq0.20$ weight % and $0\leqq Si\leqq0.13$ weight % in the melt holding furnace as shown in FIG. 2, and the molten aluminum (melt) is subjected to a degassing treatment and a removing treatment of inclusions (which is not illustrated) according to necessity, whereby a plate having a thickness of 2 to 30 mm may be produced with the twin roller continuous casting machine 6. The Hunter method and 3C method are known as an industrially operating method. A characteristic of this casting method is to use a very high cooling speed in casting. In this method, the cooling speed in casting reaches 10° C./sec or more, and Fe is easily oversaturated in an aluminum matrix. A casted plate is wound on the coiler 7, and then after subjecting it to the cold rolling with the cold rolling machine 8 as shown in FIG. 3 to roll it to a thickness of 0.5 to 0.1 mm, it is further subjected to the correction with the correction apparatus 9 to thereby produce an aluminum support.

In the above embodiment, a casted plate is directly applied to the cold rolling machine. However, without being limited thereto, the heat treatment may be carried out prior to the cold rolling. An embodiment in which the heat treatment was not inserted in the middle of the cold rolling is shown herein. However, in the case where a cooling speed in casting is 10° C./sec or more and Fe contained in an aluminum matrix causes oversaturation, a mechanical strength does not tend to be readily lowered by the heat treatment, and the heat treatment with the heat treating apparatus shown in FIG. 5 or FIG. 6 may be inserted in the middle or at the end of the cold rolling within a range satisfying the tensile strength of 15 kg/mm$^2$ or more and the offset stress of 10 kg/mm$^2$ or more after heating at 300° C. for 7 minutes. The example in which a twin roller system continuous casting apparatus was used was shown herein, but other casting methods may be used without being limited thereto as far as the cooling speed of 10° C./sec or more is satisfied. In this case, the cooling speed and the heat treatment condition are selected so that the solid solution amount of Fe is set to 10 ppm to 800 ppm.

The aluminum support thus-obtained can be subjected to graining to prepare the support for the planographic printing plate.

Next, a method for the graining is concretely explained.

As the method for graining the support for planographic printing plate according to the present invention, there is used mechanical graining, chemical graining, electrochemical graining or combination thereof.

Examples of mechanical graining methods include ball graining, wire graining, brush graining, and liquid honing. As electrochemical graining method, there is normally used. AC electrolytic etching method. As electric current, there is used a normal alternating current such as sinewaveform or a special alternating current such as squarewaveform, and the like. As a pretreatment for the electrochemical graining, etching may be conducted with caustic soda.

If electrochemical graining is conducted, it is preferably carried out with an alternating current in an aqueous solution mainly composed of hydrochloric acid or nitric acid. The electrochemical graining will be further described hereinafter.

First, the aluminum is etched with an alkali. Preferred examples of alkaline agents include caustic soda, caustic potash, sodium metasilicate, sodium carbonate, sodium aluminate, and sodium gluconate. The concentration of the alkaline agent, the temperature of the alkaline agent and the etching time are preferably selected from 0.01 to 20%, 20° to 90° C. and 5 sec. to 5 min., respectively. The preferred etching rate is in the range of 0.1 to 5 g/m$^2$.

In particular, if the support contains a large amount of impurities, the etching rate is preferably in the range of 0.01 to 1 g/m$^2$ (JP-A-1-237197). Since alkaline-insoluble substances (smut) are left on the surface of the aluminum plate thus alkali-etched, the aluminum plate may be subsequently desmutted as necessary.

The pretreatment is effected as mentioned above. In the present invention, the aluminum plate is subsequently subjected to AC electrolytic etching in an electrolyte mainly composed of hydrochloric acid or nitric acid. The frequency of the AC electrolytic current is in the range of generally 0.1 to 100 Hz, preferably 0.1 to 1.0 Hz or 10 to 60 Hz.

The concentration of the etching solution is in the range of generally 3 to 150 g/l, preferably 5 to 50 g/l. The solubility of aluminum in the etching bath is preferably in the range of not more than 50 g/l, more preferably 2 to 20 g/l. The etching bath may contain additives as necessary. However, in mass production, it is difficult to control the concentration of such an etching bath.

The electric current density in the etching bath is preferably in the range of 5 to 100 A/dm$^2$, more preferably 10 to 80 A/dm$^2$. The waveform of electric current can be properly selected depending on the required quality and the components of aluminum support used but may be preferably a special alternating waveform as described in JP-A-56-19280 and JP-B-55-19191 (corresponding to U.S. Pat. No. 4,087,341). (The term "JP-B" as used herein means an "examined Japanese patent publication"). The waveform of electric current and the liquid conditions are properly selected depending on required electricity as well as required quality and components of aluminum support used.

The aluminum plate which has been subjected to electrolytic graining is then subjected to dipping in an alkaline solution as a part of desmutting treatment to dissolve smutts away. As such an alkaline agent, there may be used caustic soda or the like. The desmutting treatment is preferably effected at a pH value of not lower than 10 and a temperature of 25° to 60° C. for a dipping time as extremely short as 1 to 10 seconds.

The aluminum plate thus-etched is then dipped in a solution mainly composed of sulfuric acid. It is preferred that the sulfuric acid solution is in the concentration range of 50 to 400 g/l, which is much lower than the conventional value, and the temperature range of 25° to 65° C. If the concentration of sulfuric acid is more than 400 g/l or the temperature of sulfuric acid is more than 65° C., the processing bath is more liable to corrosion, and in an aluminum alloy comprising not less than 0.3% of manganese, the grains formed by the electrochemical graining is collapsed. Further, if the aluminum plate is etched by not less than 0.2 g/m$^2$, the printing durability reduces. Thus, the etching rate is preferably controlled to not more than 0.2 g/m$^2$.

The aluminum plate preferably forms an anodized film thereon in an amount of 0.1 to 10 g/m$^2$, more preferably 0.3 to 5 g/m$^2$.

The anodizing conditions vary with the electrolyte used and thus are not specifically determined. In general, it is appropriate that the electrolyte concentration is in the range of 1 to 80% by weight, the electrolyte temperature is in the range of 5° to 70° C., the electric current density is in the range of 0.5 to 60 A/dm$^2$, the voltage is in the range of 1 to 100 V, and the electrolysis time is in the range of 1 second to 5 minutes.

The grained aluminum plate having an anodized film thus-obtained is stable and excellent in hydrophilicity itself and thus can directly form a photosensitive coat thereon. If necessary, the aluminum plate may be further subjected to surface treatment.

For example, a silicate layer formed by the foregoing metasilicate of alkaline metal or an undercoating layer formed by a hydrophilic polymeric compound may be formed on the aluminum plate. The coating amount of the undercoating layer is preferably in the range of 5 to 150 $mg/m^2$.

A photosensitive coat is then formed on the aluminum plate thus treated. The photosensitive printing plate is imagewise exposed to light, and then developed to make a printing plate, which is then subjected to a burning treatment and is mounted in a printing machine for printing.

Then, the present invention will now be illustrated in and by the following example.

EXAMPLES

Examples 1 to 14 and Comparative Examples 1 to 5

An aluminum material was melted and adjusted to form an ingot in a condition of a pouring temperature of 755° C. with a water-cooling fixed casting mold as shown in FIG. 1. The ingot was subjected to scalping to shave it by about 13 mm, and then it was subjected to a soaking treatment with a soaking furnace (which is not illustrated) at 550° C. for 10 hours. Thereafter, finishing to a thickness of 0.24 mm was provided only by cold rolling. In melting and adjusting, the contents of Fe and Si were changed to prepare Examples 1 to 4 of the present invention and Comparative Examples 1 to 5. Intermediate annealing was carried out in the middle of the cold rolling to deposit Fe, whereby Comparative Example 5 in which a solid solution amount of Fe was set to less than 10 ppm was prepared. The compositions of the samples is shown in Table 1.

TABLE 1

| No. | Sample | Fe content (%) | Si content (%) | Fe solid solution amount (ppm) |
|---|---|---|---|---|
| 1 | Example 1 | 0.083 | 0.035 | 50 |
| 2 | Example 2 | 0.12 | 0.053 | 80 |
| 3 | Example 3 | 0.17 | 0.04 | 90 |
| 4 | Example 4 | 0.19 | 0.12 | 120 |
| 5 | Comp. Example 1 | 0.22 | 0.01 | 120 |
| 6 | Comp. Example 2 | 0.30 | 0.013 | 110 |
| 7 | Comp. Example 3 | 0.40 | 0.01 | 140 |
| 8 | Comp. Example 4 | 0.12 | 0.152 | 80 |
| 9 | Comp. Example 5 | 0.05 | 0.05 | 8 |

The aluminum plate thus-prepared was used for the support for the planographic printing plate to subject it to etching with a 15%-aqueous solution of caustic soda at 50° C. in an etching amount of 5 $g/m^2$, and after rinsing, it was dipped in a 150 g/l sulfuric acid solution and at 50° C. for 10 sec for desmutting, followed by rinsing.

Further, the support was electrochemically grained with a 16 g/l-aqueous solution of nitric acid using an alternating (wave form) electric current described in JP-B-55-19191. The electrolytic conditions were an anode voltage $V_A$ of 14 volts and a cathode voltage $V_C$ of 12 volts, and an anode electricity quantity was set to 350 $coulomb/dm^2$.

A photosensitive planographic printing plate is prepared by coating a photosensitive solution on the substrate thus-prepared but a surface quality of the substrate before coating the photosensitive solution was evaluated herein.

It is because since developing after exposing the photosensitive planographic printing plate through a negative film or a positive film (a part of a photosensitive layer is peeled off) allows a surface itself of the substrate to become a non-image part or an image part on the planographic printing plate, a surface quality itself on the substrate surface exerts a large influence to a printing performance and visibility of the printing plate.

In addition thereto, Fe existing in a form of an intermetallic compound was extracted from the aluminum plate in a final state to measure a solid solution amount of Fe. Further, in order to confirm the local presence of a low solid solution area of Fe, an electronic probe microanalyzer (abbreviation: EPMA) was used to observe an Fe distribution on the surface. The results of a surface quality evaluation are shown in Table 2.

TABLE 2

| No. | Sample | Surface quality evaluation |
|---|---|---|
| 1 | Example 1 | Good |
| 2 | Example 2 | Good |
| 3 | Example 3 | Good |
| 4 | Example 4 | Good |
| 5 | Comp. Example 1 | A little inferior |
| 6 | Comp. Example 2 | Bad |
| 7 | Comp. Example 3 | Bad |
| 8 | Comp. Example 4 | A little inferior |
| 9 | Comp. Example 5 | Bad |

The surfaces of Comparative Examples 1 to 5 each having the bad surface quality were observed with EPMA, and it could be confirmed that the parts where an Fe solid solution amount was less than that in the surroundings were distributed in a streaked form and rough pits stood in the streaked form in the circumference thereof, which caused inferiority of the surface quality.

As described above, the samples according to the present invention can be improved in an appearance after the electrolytic graining to a large extent.

Example 5 and Comparative Example 6

Another example of the production method for the aluminum support used in the present invention is explained using the schematic view of FIG. 2.

An Al material which was adjusted to Fe of 0.10 weight %, Si of 0.04 weight %, Al≧99.7 weight % and the balance of inevitable impurity elements was melted in the melt holding furnace 5, and a plate having a thickness of 7 mm was continuously casted with the twin roller continuous casting machine 6. After wound with the coiler 7, it was subsequently applied to the cold rolling machine and the correction apparatus each shown in FIGS. 3 and 4, respectively, to produce the aluminum support, whereby the sample of Example 5 of the present invention was prepared.

Further, an Al material which was adjusted to Fe of 0.30 weight %, Si of 0.015 weight %, Al≧99.5 weight % and the balance of inevitable impurity elements was used to produce the aluminum alloy support in the same manner, whereby the sample of Comparative Example 6 was prepared.

The samples thus-prepared were subjected to the same graining treatment as that in Example 1 to similarly evaluate the surface quality. The evaluation results are shown in Table 3.

TABLE 3

| No. | Sample | Surface quality evaluation |
|---|---|---|
| 10 | Example 5 | Good |
| 11 | Comp. Example 6 | Bad |

The surfaces of Comparative Example 6 having the bad surface quality were observed with EPMA, and it could be confirmed that the parts where an Fe solid solution amount was less than that in the surroundings were distributed in a streaked form and rough pits stood in the streaked form in the circumference thereof, which caused inferiority of the surface quality.

As described above, the samples according to the present invention can be extremely improved in an appearance after the electrolytic graining. Since a method in which a driven casting mold such as a twin roller system can extremely abbreviate a process, a production cost can be cut as well.

Casting with the twin roller continuous casting machine is demonstrated in Example 5 and Comparative Example 6 but a twin belt continuous casting machine can be used to obtain the similar results without being limited thereto.

Examples 6 to 16 and Comparative Examples 7 to 16

An aluminum material was melted to form an ingot in a condition of a pouring temperature of 755° C. with the water-cooling fixed casting mold as shown in FIG. 1. The ingot was subjected to the scalping to shave it by about 12 mm, and then, a soaking treatment was carried out with a soaking furnace (which is not illustrated) at 570° C. for 8 hours, followed by subjecting it to the cold rolling. In melting, the contents of Fe and Si were changed to prepare the examples of the present invention and the comparative examples regarding the alloy components. Further, a manner for providing the heat treatment in the middle or at the end of the cold rolling was changed to prepare the examples of the present invention and the comparative examples regarding a tensile strength and an offset stress after the heat treatment.

The examples and the comparative examples each prepared were evaluated in a form of a thickness of 0.24 mm. The compositions of the respective samples is shown in Table 4.

TABLE 4

| | | Trace component content | | Heat treatment condition | | |
|---|---|---|---|---|---|---|
| No. | Sample | Fe content (%) | Si content (%) | Plate thickness | System | Temperature × hrs |
| 11 | Example 6 | 0.083 | 0.035 | — | — | None |
| 12 | Example 7 | 0.12 | 0.053 | — | — | None |
| 13 | Example 8 | 0.17 | 0.04 | — | — | None |
| 14 | Example 9 | 0.19 | 0.12 | — | — | None |
| 15 | Example 10 | 0.083 | 0.035 | 0.75 | Batch | 370° C. × 2 hrs |
| 16 | Example 11 | 0.083 | 0.035 | 1.20 | Batch | 370° C. × 2 hrs |
| 17 | Example 12 | 0.083 | 0.035 | 1.00 | Batch | 500° C. × 10 min |
| 18 | Example 13 | 0.083 | 0.035 | 0.50 | CAL | 500° C. × 3 sec |
| 19 | Example 14 | 0.083 | 0.035 | 0.50 | CAL | 350° C. × 3 sec |
| 20 | Example 15 | 0.083 | 0.035 | 0.24 | CAL | 350° C. × 3 sec |
| 21 | Example 16 | 0.083 | 0.035 | 0.65 | Batch | 420° C. × 1 hr |
| 22 | Comp. Example 7 | 0.083 | 0.035 | 0.50 | Batch | 280° C. × 10 hrs |
| 23 | Comp. Example 8 | 0.12 | 0.053 | 0.50 | Batch | 280° C. × 10 hrs |
| 24 | Comp. Example 9 | 0.17 | 0.04 | 0.50 | Batch | 280° C. × 10 hrs |
| 25 | Comp. Example 10 | 0.19 | 0.12 | 0.50 | Batch | 280° C. × 10 hrs |
| 26 | Comp. Example 11 | 0.35 | 0.07 | 0.50 | Batch | 280° C. × 10 hrs |
| 27 | Comp. Example 12 | 0.083 | 0.035 | 0.50 | Batch | 370° C. × 2 hrs |
| 28 | Comp. Example 13 | 0.083 | 0.035 | 1.50 | Batch | 370° C. × 2 hrs |
| 29 | Comp. Example 14 | 0.083 | 0.035 | 0.24 | Batch | 350° C. × 1 hr |
| 30 | Comp. Example 15 | 0.083 | 0.035 | 0.65 | Batch | 380° C. × 1 hr |
| 31 | Comp. Example 16 | 0.083 | 0.035 | 0.65 | Batch | 340° C. × 1 hr |

These samples were used to measure the tensile strength and subjected to heat treatment in an electric furnace at 300° C. for 7 minutes while measuring a sample temperature with a thermocouple, followed by measuring the offset stress.

The measured results are shown in Table 5.

TABLE 5

| Sample | | Tensile strength | Offset stress after heating at 300° C. for 7 minutes |
|---|---|---|---|
| No. | Example | (kg/mm$^2$) | (kg/mm$^2$) |
| 11 | Example 6 | 16.5 | 11.0 |
| 12 | Example 7 | 17.0 | 11.2 |
| 13 | Example 8 | 17.6 | 11.8 |
| 14 | Example 9 | 18.0 | 12.5 |
| 15 | Example 10 | 14.2 | 10.1 |
| 16 | Example 11 | 16.0 | 10.5 |
| 17 | Example 12 | 14.5 | 10.3 |
| 18 | Example 13 | 16.1 | 10.5 |
| 19 | Example 14 | 16.3 | 10.8 |
| 20 | Example 15 | 14.0 | 10.4 |
| 21 | Example 16 | 14.0 | 10.1 |
| 22 | Comp. Example 7 | 12.6 | 6.8 |
| 23 | Comp. Example 8 | 13.1 | 7.2 |
| 24 | Comp. Example 9 | 13.5 | 7.7 |
| 25 | Comp. Example 10 | 14.2 | 7.8 |
| 26 | Comp. Example 11 | 16.0 | 9.5 |
| 27 | Comp. Example 12 | 12.2 | 8.2 |
| 28 | Comp. Example 13 | 16.2 | 9.9 |
| 29 | Comp. Example 14 | 9.5 | 7.0 |

TABLE 5-continued

| Sample No. | Sample Example | Tensile strength ($kg/mm^2$) | Offset stress after heating at 300° C. for 7 minutes ($kg/mm^2$) |
|---|---|---|---|
| 30 | Comp. Example 15 | 14.5 | 9.8 |
| 31 | Comp. Example 16 | 14.6 | 9.9 |

As is apparent from the results of Table 5, any of Comparative Examples 7 to 16 (Samples No. 22 to 31) has the offset stress of less than 10 $kg/mm^2$.

The same Sample Nos. 11 to 31 as described above were used for the support for the planographic printing plate to subject them to etching with a 15%-aqueous solution of caustic soda at 50° C. in an etching amount of 5 $g/m^2$, and after rinsing, they were dipped in a 150 g/l-sulfuric acid solution and at 50° C. for 10 sec for desmutting, followed by rinsing.

Further, the supports were electrochemically grained with a 16 g/l-aqueous solution of nitric acid using an alternating (wave form) current described in JP-B-55-19191. The electrolytic conditions were an anode voltage $V_A$ of 14 volts and a cathode voltage $V_C$ of 12 volts, and an anode electricity quantity was set to 350 coulomb/$dm^2$.

Subsequently, they were subjected to a chemical etching treatment with a 5%-aqueous solution of sodium hydroxide so that a dissolved amount of the aluminum plate was 0.5 $g/m^2$, and then, they were dipped in a 300 g/l-sulfuric acid solution at 60° C. for 20 seconds for the desmutting treatment.

Further, they were subjected to an anodic oxidation treatment for 60 seconds in a 150 g/l-aqueous solution of sulfuric acid and having an aluminum ion concentration of 2.5 g/l at a direct electric current of a voltage of 22 V with a distance of 150 mm between the electrodes.

The following composition was coated on the supports 11 to 31 thus-prepared in a dry coated weight of 0.2 $g/m^2$ to provide a photosensitive layer.

Photosensitive solution:

| | |
|---|---|
| N-(4-hydroxyphenyl)methacrylamide/2-hydroxyethyl methacrylate/acrylonitrile/methyl methacrlate/methacrylic acid (15/10/3/38/7 by mole ratio) copolymer (average molecular weight: 60,000) | 5.0 g |
| Hexafluorophosphate of a condensate of 4-diazophenylamine and formaldehyde | 0.5 g |
| Phosphorous acid | 0.05 g |
| Victoria Blue BOH (manufactured by Hodogaya Chemical Co., Ltd.) | 0.1 g |
| 2-Methoxyethanol | 100.0 g |

The photosensitive planographic printing plates thus-prepared were subjected to exposure for 50 seconds with a metal halide lump of 3 kw from a distance of 1 m through a transparent negative film, and then it was subjected to development with a developing solution of the following composition and to a burning treatment at 300° C. for 7 minutes, followed by gumming in gum arabic, whereby the planographic printing plates were prepared.

Developing solution:

| | |
|---|---|
| Sodium sulfite | 5.0 g |
| Benzyl alcohol | 30.0 g |
| Sodium carbonate | 5.0 g |
| Sodium isopropylnaphthalenesulfonate | 12.0 g |
| Pure water | 1000.0 g |

A printing test was carried out in a usual procedure using the planographic printing plate thus-prepared to evaluate a printing performance.

A surface quality of the support before coating the photosensitive layer was evaluated at the same time. This is because since developing after exposing the photosensitive planographic printing plate through a negative film or a positive film (a part of a photosensitive layer is peeled off) allows a surface itself of the support to become a non-image part or an image part on the planographic printing plate, a surface quality itself on the support surface exerts a large influence to a printing performance and visibility of the printing plate.

The above evaluation results are shown in Table 6.

TABLE 6

| Sample No. | Sample Example | Surface quality evaluation | Printing performance evaluation |
|---|---|---|---|
| 11 | Example 6 | Good | Good |
| 12 | Example 7 | Good | Good |
| 13 | Example 8 | Good | Good |
| 14 | Example 9 | Fair | Good |
| 15 | Example 10 | Fair | Good |
| 16 | Example 11 | Fair | Good |
| 17 | Example 12 | Fair | Good |
| 18 | Example 13 | Good | Good |
| 19 | Example 14 | Good | Good |
| 20 | Example 15 | Good | Good |
| 21 | Example 16 | Fair | Good |
| 22 | Comp. Example 7 | Good | Bad |
| 23 | Comp. Example 8 | Good | Bad |
| 24 | Comp. Example 9 | Good | Bad |
| 25 | Comp. Example 10 | Fair | Bad |
| 26 | Comp. Example 11 | Bad | Fair |
| 27 | Comp. Example 12 | Bad | Bad |
| 28 | Comp. Example 13 | Bad | Fair |
| 29 | Comp. Example 14 | Fair | Bad |
| 30 | Comp. Example 15 | Bad | Fair |
| 31 | Comp. Example 16 | Bad | Fair |

As shown above, Examples 6 to 16 (Sample Nos. 11 to 21) of the planographic printing plates produced by the production method for the support for the planographic printing plate according to the present invention have small heat softening property against the burning treatment, an excellent printing performance and a good surface quality.

Example 17 and Comparative Examples 17 and 18

Another example of the production method for the aluminum support used in the present invention with the twin roller continuous casting machine 6 shown in the schematic view of FIG. 2 is explained.

An Al material which was adjusted to Fe of 0.12%, Si of 0.05%, Al of 99.7% and the balance of inevitable impurity elements was melted in the melt holding furnace 5 to continuously cast a plate having a thickness of 7.5 mm with the twin roller continuous casting machine 6, wherein a cooling speed was calculated with a non-contact type thermometer to find that it was 250° C./sec. After wound with the coiler 7, it was subsequently applied to the cold rolling machine 8 and the correction apparatus 9 shown in FIGS. 3 and 4, respectively, to produce the aluminum support having a thickness of 0.24 mm, whereby the sample of Example 18 of the present invention was prepared.

Further, the aluminum material having the same composition was used to cast a plate having a thickness of 7.5 mm with a casting mold (which is not illustrated) made of carbon, wherein a cooling speed was measured and calculated with a thermocouple and a non-contact type thermometer to find that it was 5° C./sec.

The cold rolling and the correction were carried out in the same manner as in Example 17 to produce the aluminum support having a thickness of 0.24 mm, whereby the sample of Comparative Example 17 was prepared.

Further, an Al material which was adjusted to Fe of 0.30%, Si of 0.15%, Al of 99.5% and the balance of inevitable impurity elements was used to produce the aluminum support having the thickness of 0.24 mm in the same manner as in Example 17 with the continuous casting apparatus shown in FIG. 2, whereby the sample of Comparative Example 18 was prepared.

The samples thus-prepared were used to measure the strength in the same manner as in Examples 6 to 16 and Comparative Examples 7 to 16.

The measured results are shown in Table 7.

TABLE 7

| Sample | | Tenile Strength | Offset stress after heating at 300° C. for 7 minutes |
|---|---|---|---|
| No. | Example | (kg/mm²) | (kg/mm²) |
| 32 | Example 17 | 17.0 | 13.5 |
| 33 | Comp. Example 17 | 16.0 | 10.3 |
| 34 | Comp. Example 18 | 18.0 | 14.0 |

Further, the planographic printing plates were produced in the same procedure as in Examples 6 to 16 and Comparative Examples 7 to 16 to evaluate printing performance and surface quality in the same manner as in Examples 6 to 16 and Comparative Examples 7 to 16. The evaluation results of the printing performance and the surface quality are shown in Table 8.

TABLE 8

| Sample | | Printing performance | Surface quality |
|---|---|---|---|
| No. | Example | evaluation | evaluation |
| 32 | Example 17 | Good | Good |
| 33 | Comp. Example 17 | Fair | Bad |
| 34 | Comp. Example 18 | Fair | Bad |

As shown above, Example 17 of the planographic printing plates produced by the production method for the support for the planographic printing plate according to the present invention have the small heat softening property against the burning treatment, an excellent printing performance and a good surface quality.

As described above, the planographic printing plates produced by the production method for the support for the planographic printing plate according to the present invention provides less dispersion in a material quality and an improved yield in a electrolytic graining treatment as compared with a conventional one and have particularly small thermosoftening against the burning treatment, an excellent printing performance and a good surface quality after the graining. Further, enabling to curtail the elements to a small amount leads to possibility to cut a material cost as well and contributes to improvement in a quality of the support for the planographic printing plate and outstanding cost reduction. Use of a driven casting mold such as a twin roller continuous casting machine enables to further curtail a production cost.

While the invention has been described in detail and with reference to specific embodiments thereof, it will be apparent to one skilled in the art that various changes and modifications can be made therein without departing from the spirit and scope thereof.

What is claimed is:

1. A method for producing a support for a planographic printing plate having substantially no streaks or granular unevenness, which comprises the steps of:

a) melting and mixing at least 99.7 weight % aluminum with $0<Fe\leqq0.19$ weight %, $0<Si\leqq0.12$ weight %, and the balance of inevitable impurity elements to form an aluminum composition;

b) preparing a cast ingot from the aluminum composition with a fixed water-cooling mold;

c) subjecting the cast ingot to scalping to form a scalped ingot;

d) subjecting the scalped ingot to a soaking treatment at a temperature of 280° C. to 650° C. for 2 hours to 15 hours to form a treated cast ingot;

e) rolling the treated cast ingot to a thickness of 0.5 to 0.1 mm to form a rolled material containing from about 10 to 800 ppm Fe in solid solution with no more heat treatment;

f) carrying out correction of the rolled material to prepare a support; and g) subjecting the support to graining.

2. A method for producing a support for a planographic printing plate having substantially no streaks or granular unevenness, which comprises the steps of:

a) melting and mixing at least 99.7 weight % aluminum with $0<Fe\leqq0.19$ weight %, $0<Si\leqq0.12$ weight %, and the balance of inevitable impurity elements to form an aluminum composition;

b) casting a thin plate from the aluminum composition with a driven water-cooling casting mold;

c) rolling the thin plate to a thickness of 0.5 to 0.1 mm to form a rolled plate containing from about 10 to 800 ppm Fe in solid solution without any heat treatment;

d) carrying out correction of the rolled plate by cold rolling to prepare a support; and e) subjecting the support to graining.

* * * * *